United States Patent [19]

Meister

[11] Patent Number: 4,788,517

[45] Date of Patent: Nov. 29, 1988

[54] SEALED PROXIMITY SWITCH ASSEMBLY

[75] Inventor: Jack B. Meister, Convent Station, N.J.

[73] Assignee: Beta Mfg. Co., Warren, Mich.

[21] Appl. No.: 106,189

[22] Filed: Oct. 8, 1987

[51] Int. Cl.[4] ..... H01H 9/00

[52] U.S. Cl. ..... 335/205; 200/61.81; 200/61.62

[58] Field of Search ..... 200/61.62, 61.69, 61.7, 200/61.76, 61.78, 61.79, 61.8, 61.81, 61.82, 159 R, 295, 296; 335/205, 206

[56] References Cited

U.S. PATENT DOCUMENTS

| | | | |
|---|---|---|---|
| 265,485 | 10/1882 | Cochran | 335/237 |
| 2,779,833 | 1/1957 | Farison | 200/61.82 |
| 2,921,155 | 1/1960 | Basso | 200/61.82 |
| 2,966,561 | 12/1960 | Durant | 335/206 X |
| 3,172,983 | 3/1965 | Zoda | 200/295 |
| 3,187,127 | 6/1965 | Hess | 200/61.41 |
| 3,190,982 | 6/1965 | Woodcock | 200/61.81 |
| 3,201,537 | 8/1965 | Klatte et al. | 200/61.41 |
| 3,226,506 | 12/1965 | Angrisani | 335/205 |
| 3,243,544 | 3/1966 | Mayer | 335/206 |
| 3,305,805 | 2/1967 | Tann | 335/153 |
| 3,348,174 | 10/1967 | Scheidig | 335/153 |
| 3,426,166 | 2/1969 | Canceill | 200/61.62 |
| 3,459,911 | 8/1969 | Fischer | 200/61.45 R |
| 3,487,346 | 12/1969 | Gardel et al. | 200/295 X |
| 3,493,701 | 2/1970 | Clarke | 200/61.45 R |
| 3,569,643 | 3/1971 | Clarke et al. | 200/61.53 |
| 3,737,599 | 6/1973 | Zuvela | 200/61.45 R |
| 3,800,254 | 3/1974 | Beery | 335/205 |
| 3,821,529 | 6/1974 | Kallage, Jr. et al. | 200/61.62 X |
| 4,038,620 | 7/1977 | Shlesinger et al. | 335/153 |
| 4,039,985 | 8/1977 | Shlesinger et al. | 335/153 |
| 4,241,337 | 12/1980 | Prada | 340/547 |
| 4,331,945 | 5/1982 | Cattani | 335/205 |
| 4,336,518 | 6/1982 | Holce et al. | 335/205 |
| 4,454,397 | 6/1984 | Kim | 200/295 X |
| 4,456,897 | 6/1984 | Holce et al. | 335/205 |

*Primary Examiner*—J. R. Scott

*Attorney, Agent, or Firm*—Barnes, Kisselle, Raisch, Choate, Whittemore & Hulbert

[57] ABSTRACT

A sealed proximity switch assembly comprising a housing of non-magnetic material, contacts mounted in the housing, a movable contact member of electrically conductive material mounted within the housing for movement toward and away from engagement with the contacts, a spring yieldingly urging the contact member into engagement with the contacts, and a magnet within the housing and connected to the contact member such that when a portion of a movable member is in proximity with the housing, the magnet is attracted toward the portion moving the contact member out of engagement with the contacts.

19 Claims, 3 Drawing Sheets

SEALED PROXIMITY SWITCH ASSEMBLY

This invention relates to proximity assemblies.

BACKGROUND AND SUMMARY OF THE INVENTION

Proximity switches which are actuated by relative movement between members are well known in the art. For example, in automobiles and the like, it is common to provide a proximity switch in the form of a door jamb switch on the body of an automotive vehicle which is actuated when the door is closed to electrically disconnect one or more lights within the vehicle and is deactivated when the door is open to make a connection illuminating the lights within the vehicle.

One of the problems in connection with such proximity switch assemblies is that the electrical connections must be insulated from moisture and the like. This necessitates the use of elastic boots.

Among the objectives of the present invention are to provide a sealed proximity switch assembly which obviates the need for special protection or isolation against moisture; which utilizes a sealed housing; which incorporates a minimum number of parts and therefore is simpler to manufacture and is less likely to malfunction; and which is automatically adjustable for tolerances.

In accordance with the invention, the sealed proximity switch assembly comprises a housing of non-magnetic material contacts mounted in said housing, a movable member of electrically conductive material mounted within said housing for movement toward and away from engagement with said contacts, a spring yieldingly urging the contact member into engagement, with the contacts, a magnet within said housing and connected to the contact member such that when a portion of a movable member is in proximity with said housing, the magnet is attracted toward the portion moving the contact member out of engagement with the contacts. Means are provided for automatic adjustment when the switch assembly is first positioned in the vehicle.

DESCRIPTION

Figure 1:
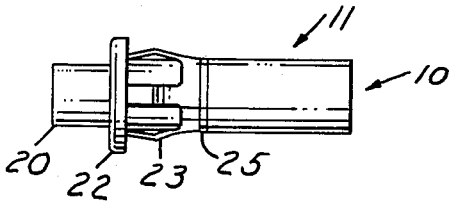
FIG. 1 is a side view of a sealed door jamb switch assembly embodying the invention.
Figure 2:
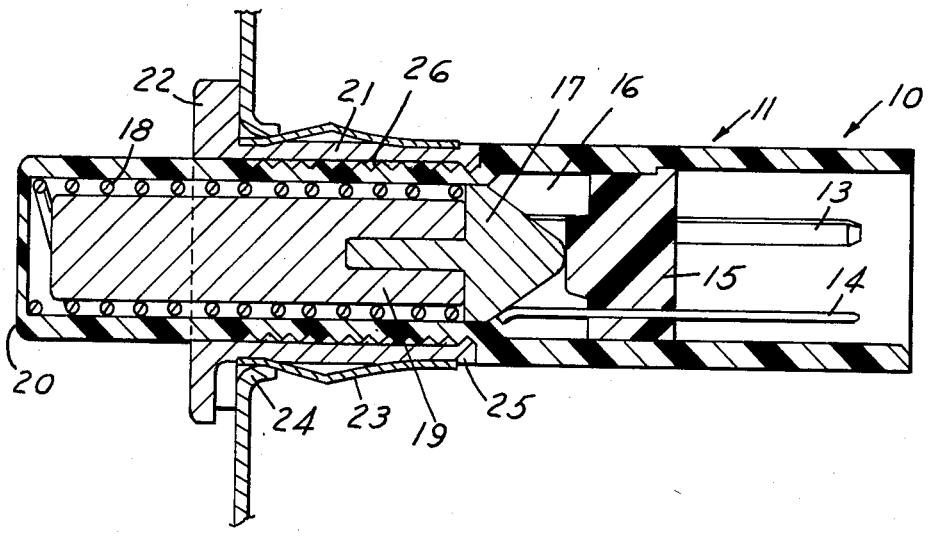
FIG. 2 is a longitudinal sectional view of the switch assembly on an enlarged scale showing the switch assembly when it is first assembled on a vehicle.
Figure 3:
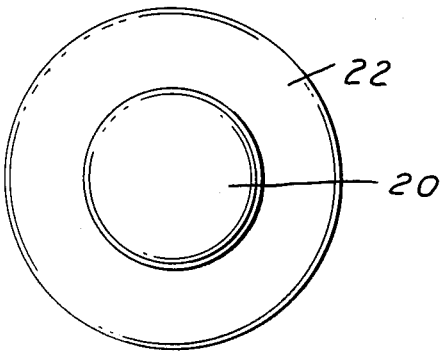
FIG. 3 is an end view taken from the left as viewed in FIG. 2.
Figure 4:
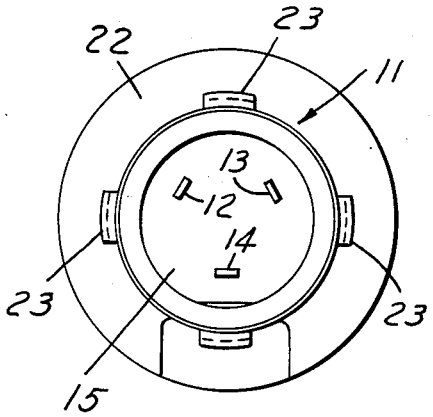
FIG. 4 is an end view taken from the right as viewed in FIG. 2.

Referring to FIGS. 1–6, the sealed proximity switch is shown as used in a door jamb switch assembly for an automotive vehicle. The sealed door jamb switch assembly 10 embodying the invention comprises a sealed housing 11 that supports at one end spaced contact members 12, 13, 14 which are embedded in an end member 15 that closes and seals the housing 11. The contacts 12, 13, 14 extend axially inwardly into the sealed portion 16 of the housing. A contact member 17 having a conical end terminating in a convex top is yieldingly urged toward the contacts by a compression spring 18. A permanent magnet 19 is fixed to the contact member 17 so that the magnet member 19 and contact member 17 are movable together. The other end of the housing 11 is closed by an integral wall 20. Spring 18 comprises a helical spring surrounding magnet 19 and interposed between wall 20 and the contact member 17.

A mounting cover 21 that is tubular and extends over the periphery of the end of the housing 11 and includes a flange 22 for engaging a panel or other portion of a door jamb of a automotive vehicle. Circumferentially spaced flat spring members 23 are mounted on the exterior of the housing 11 and snap behind a flange 24 that defines the opening into which the switch assembly 10 is inserted.

In order to accommodate for tolerances in vehicle manufacture, provision is made for automatic adjustment of the switch assembly which includes radially inwardly extending and radially movable symmetrical serrations or teeth 25 on the tubular portion of the cover 21 and a plurality of complementary longitudinally spaced serrated teeth 26 on the housing 11.

The housing 11 and cover 22 are made of non-magnetic material, preferably plastic such as acetal resin.

Figure 5:
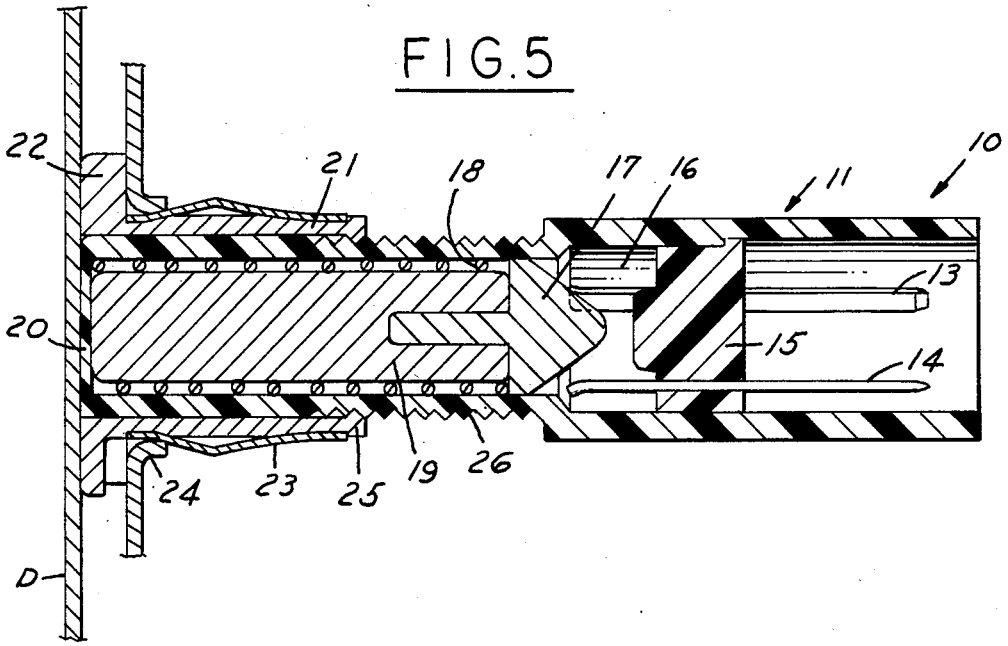
FIG. 5 is a view similar to FIG. 2 showing the switch assembly after it has been mounted on a vehicle and the door is closed.

When the switch is first mounted in a vehicle, automatic adjustment occurs when the door D is closed and engages the housing 11 causing the housing 11 to move axially inwardly to the position shown. During this movement, there is a ratcheting action between serrations 25 and teeth 26 as may be required to accommodate tolerances, as shown in FIG. 5. At the same time, the magnet 19 is attracted by its magnetic field toward the ferromagnetic portion of the door D. As the magnet is moved to the left relative to housing 11, it carries the associated contact member 17 to the left thereby interrupting the circuit with the contact members 12, 13, 14. Thereafter, when the door opens the housing 11 and cover 21 remain in the adjusted position as shown in FIG. 6.

Figure 6:
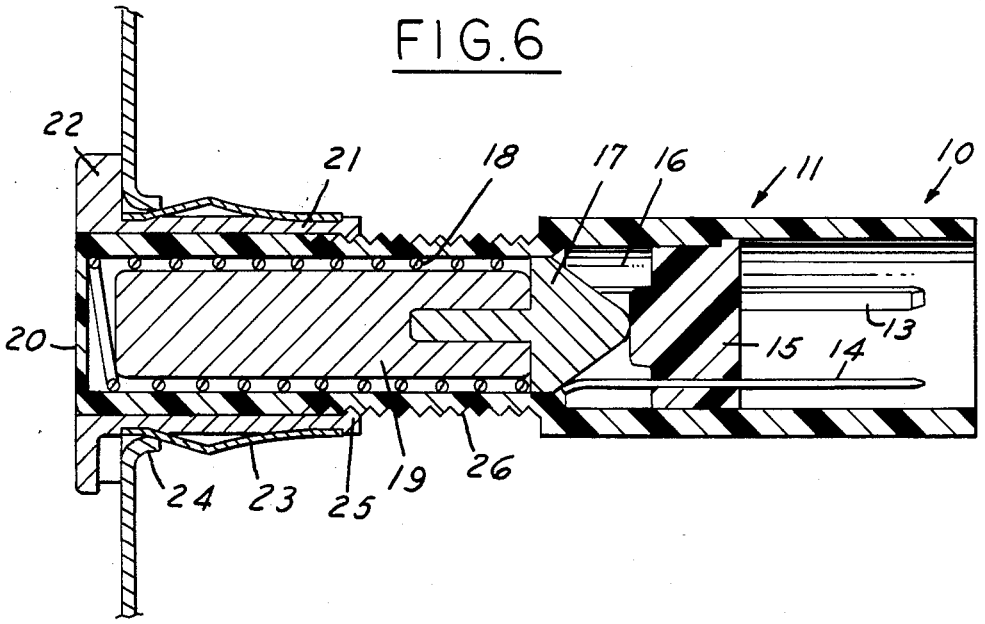
FIG. 6 is a view similar to FIG. 5 with the door open.

When the door of the vehicle is opened, the magnet attraction to the ferromagnetic portion of the door D and the magnetic field of the magnet are broken so that the spring 18 moves the magnet and associated contact member to the right as viewed in FIG. 6 making contact as required.

Figure 7:
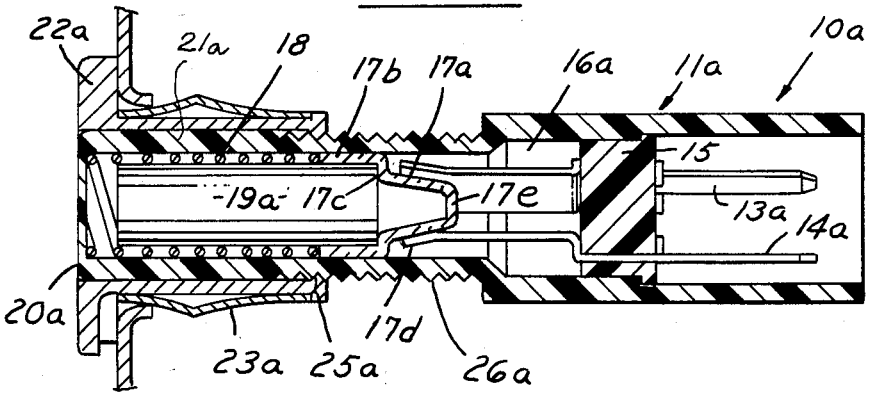
FIG. 7 is a longitudinal sectional view similar to FIG. 3 of a modified sealed door jamb switch.

The modified form of the switch **10*a* shown in FIG. 7 is similar to the first form except that contact 17*a* is hollow thereby reducing the weight of the contact 17*a*. Contact 17*a* includes a cylindrical portion 17*b* into which the cylindrical magnet 19*a* extends and an integral shoulder 17*c* against which the magnet 19*a* abuts. Contact 17*a* further includes an integral frustoconical portion 17*d* and an end portion 17*e*. This form of switch has the advantage of utilizing a cylindrical magnet 19*a* that does not require special shaping to receive the contact 17*a*, as contrasted to the form of jamb switch shown in FIGS. 1–6**.

As in the previous forms of the invention, the switch **10*a* includes a sealed portion 16*a* of housing 11*a*, and contact members 13*a*, 14*a* as well as a spaced contact member (not shown) which are adapted to engage the frustoconical portion 17*d* of contact 17*a*. The switch 10*a* also includes a housing, a mounting cover 21*a* and flange 22a as well as serrations or teeth 25a, 26a, flat springs 23a**.

Figure 8:
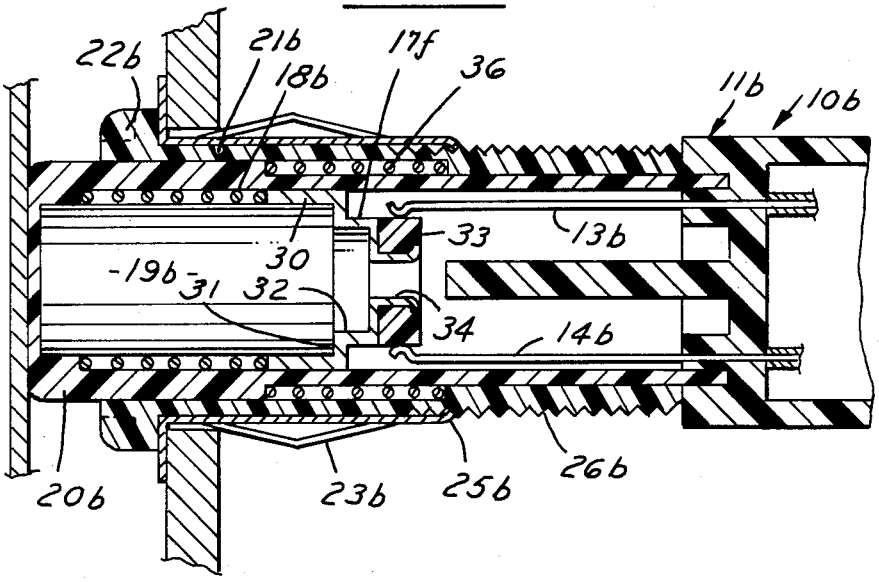
FIG. 8 is a longitudinal sectional view similar to FIG. 5 showing a further modified sealed door jamb switch.

The modified form of switch 10b shown in FIG. 8 differs primarily in that it utilizes a different configuration of contact 17f and contact members 13b and 14b. A similar third contact member (not shown) is provided in circumferentially spaced relation to contact members 13b, 14b. Contact 17f includes a cylindrical portion 30 into which the cylindrical magnet 19b extends and abuts against a transverse annular portion 31. The contact 17f includes a further cylindrical portion 32 that extends axially and is adapted to be engaged by the ends of the contact members 13b and 14b as well as the third contact member (not shown). In the door closed position, the contact members 13b, 14b rest upon a cylindrical insulator ring 33, as shown in FIG. 8, which is supported by a further tubular portion of smaller diameter on the end of the contact 17f. Insulator ring 33 is made of plastic insulating material which is arc resistant. As in the previous forms of the invention, the switch 10b includes flat spring members 23b, a housing 20b, mounting cover 21b, and an integral wall 22b.

Prior to the first door closure, the housing 11 extends beyond the panel or other portion of a door jamb, as in the previous forms of switch. When the door is first closed, spring 18b is compressed and the housing 11 is forced axially inwardly and retained in the adjusted position by engagement of the teeth 25b, 26b. In this position, the magnet 19b is drawn against the door panel. When the door is open, the magnet 19b is no longer attracted to the door panel and spring 18b drives the contact 17f so that the contact members engage the cylindrical portion 32 completing a circuit to energize one or more lights. At the same time, a second spring 36 interposed between the housing 11b and cover 21b moves the housing 11b outwardly a short distance to assure that the door will make intimate contact with the housing upon the next closing of the door.

In this form, the flexing of the contact members 13b and 14b against the insulator bar 33 and contact portion 32 provides the same force on each so that there is strong contact pressure. The magnet, on the other hand, need only be strong enough to overcome the axial frictional component of force and therefore can be made as small as possible.

Although the proximity switch embodying the invention has been described as having utility in connection with a door jamb switch assembly, it can be used wherever a proximity switch is required between members that are moved relative to one another.

It can thus be seen that there has been provided a sealed proximity switch assembly which obviates the need for special protection or isolation against moisture; which utilizes a sealed housing; which incorporates a minimum number of parts and therefore is simpler to manufacture and is less likely to malfunction; and which is automatically adjustable for tolerances.

I claim:

1. A sealed proximity switch assembly comprising a closed housing of non-magnetic material, said housing having a side wall, an outer end wall and an inner end wall, a plurality of contacts mounted in said inner wall of said housing and extending into said housing, a movable contact member of electrically conductive material mounted within said housing and guided therein for movement toward and away from engagement with said contacts, a permanent magnet within said housing and connected to said contact member, a spring in said housing yieldingly normally urging said magnet and said contact member in one position relative to said contacts, such that when the switch assembly is supported so that a ferromagnetic member is in proximity with the outer end wall of said housing, the magnet is attracted toward the ferromagnetic member moving the contact member to a second position relative to said contacts.

2. The switch assembly set forth in claim 1 wherein said side wall of said housing is tubular.

3. The switch assembly set forth in claim 2 wherein said contacts extend through the inner wall of said housing to the exterior.

4. The switch assembly set forth in claim 1 wherein said spring surrounds said magnet and is interposed between the outer end wall of the housing and said contact member.

5. The switch assembly set forth in claim 1 wherein said spring urges said contact member into engagement with said contact members.

6. The switch assembly set forth in claim 5 including a mounting cover supporting said housing, and automatic adjustment means between said mounting cover and said housing operable upon the first closing of a member with said outer end wall to adjust the relative position of said switch assembly to said cover to accommodate manufacturing tolerances.

7. The switch assembly set forth in claim 6 including a second spring interposed between said housing and said cover and adapted to move the housing axially outwardly relative to the cover upon moving the ferromagnetic member.

8. The switch assembly set forth in claim 1 wherein said magnet has a uniform transverse cross section.

9. The switch assembly set forth in claim 1 wherein said contact member includes a cylindrical portion which extends into said magnet.

10. The switch assembly set forth in claim 1 wherein said contact member includes a contacting portion and an insulating portion on said contact member of substantially the same configuration, said contacts engaging said contacting portion in one position of said contact member and said insulation portion in another position of said contact member.

11. The switch assembly set forth in claim 2 wherein said contact member includes an integral shoulder against which said magnet is urged by said spring.

12. The switch assembly set forth in claim 11 wherein said contact member includes a cylindrical portion into which said magnet extends, an integral radial wall against which said magnet abuts and an integral frustoconical portion engaged by said contacts.

13. The switch assembly set forth in claim 12 wherein said frustoconical portion is hollow and has a closed end.

14. The switch assembly set forth in claim 13 including a mounting cover supporting said housing, and automatic adjustment means between said mounting cover and said housing operable upon the first closing of a member with said outer end wall to adjust the relative position of said switch assembly to said cover to accommodate manufacturing tolerances.

15. The switch assembly set forth in claim 14 including a second spring interposed between said housing and said cover and adapted to move the housing axially outwardly relative to the cover upon moving the ferromagnetic member.

16. The switch assembly set forth in claim 13 wherein said contact member includes a cylindrical contacting portion adjacent said shoulder and a cylindrical insulating portion having the same diameter as the cylindrical portion, said contacts engaging said cylindrical contacting portion when said magnet is in normal position and said contacts engaging said cylindrical insulating portion when said magnet is attached toward the ferromagnetic member.

17. The switch assembly set forth in claim 14 including a second spring interposed between said housing and said cover and adapted to move the housing axially outwardly relative to the cover.

18. The switch assembly set forth in claim 16 including a mounting cover supporting said housing, and automatic adjustment means between said mounting cover and said housing operable upon the first closing of a member with said outer end wall to adjust the relative position of said switch assembly to said cover to accommodate manufacturing tolerances.

19. The switch assembly set forth in claim 18 including a second spring interposed between said housing and said cover and adapted to move the housing axially outwardly relative to the cover upon moving the ferromagnetic member.

* * * * *